US009546038B2

(12) United States Patent
Schnabel

(10) Patent No.: US 9,546,038 B2
(45) Date of Patent: Jan. 17, 2017

(54) DISPOSABLE WHOLE BEAN COFFEE FILTER

(75) Inventor: Barbara L Schnabel, Chappaqua, NY (US)

(73) Assignee: CONAIR CORPORATION, Stamford, CT (US)

( * ) Notice: Subject to any disclaimer, the term of this patent is extended or adjusted under 35 U.S.C. 154(b) by 418 days.

(21) Appl. No.: 12/884,318

(22) Filed: Sep. 17, 2010

(65) Prior Publication Data

US 2011/0076360 A1 Mar. 31, 2011

Related U.S. Application Data

(60) Provisional application No. 61/244,304, filed on Sep. 21, 2009.

(51) Int. Cl.
*B65D 85/804* (2006.01)
*B65D 65/46* (2006.01)

(52) U.S. Cl.
CPC ..... *B65D 85/8043* (2013.01); *B65D 65/466* (2013.01)

(58) Field of Classification Search
CPC ..... B65B 29/02; B65B 29/06; A47J 31/0668; B65D 85/8043; B65D 85/804; B65D 65/466
USPC ..... 426/77–84; 99/295, 323, 286
See application file for complete search history.

(56) References Cited

U.S. PATENT DOCUMENTS

| | | | | |
|---|---|---|---|---|
| 2,620,276 | A * | 12/1952 | Heyman | 426/77 |
| 2,778,739 | A * | 1/1957 | Rodth | 426/77 |
| 2,968,560 | A * | 1/1961 | Goros | 99/295 |
| 4,465,697 | A * | 8/1984 | Brice et al. | 426/79 |
| 5,242,702 | A * | 9/1993 | Fond | 426/433 |
| 6,740,345 | B2 * | 5/2004 | Cai | 426/77 |
| 2009/0214713 | A1 * | 8/2009 | Banim et al. | 426/80 |
| 2010/0303964 | A1 * | 12/2010 | Beaulieu et al. | 426/77 |

* cited by examiner

*Primary Examiner* — Erik Kashnikow
*Assistant Examiner* — Chaim Smith
(74) *Attorney, Agent, or Firm* — Grogan, Tuccillo & Vanderleeden, LLP

(57) ABSTRACT

A pre-packaged, sealed container enclosing whole coffee beans is sized to correspond to a single serving of coffee, or multiple servings. The container is used with a machine that selectively lowers a grinding blade into the container for grinding the whole beans. The freshly made grounds remain in the same container and heated water is introduced into the container. Freshly brewed coffee is produced and drips out of one or more openings in the bottom of the container after passing through the filter. The container is sealed for storage and shipping with an airtight membrane or cover such as plastic, foil etc.

6 Claims, No Drawings

DISPOSABLE WHOLE BEAN COFFEE FILTER

CROSS-REFERENCE TO RELATED APPLICATIONS

This application relates to and claims priority from U.S. Provisional Application 61/244,304.

BACKGROUND OF THE INVENTION

The present invention relates to electric appliances and, more particularly, to electric coffee makers.

Description of Related Art

Various design exist for electric coffee makers. Drip-style coffee makers utilize a brew basket that holds coffee grounds and a filter, and heated water is delivered into the basket and, under the force of gravity, brewed coffee drips out of the brew basket. Certain known coffee makers include a grinding feature in which hole coffee beans are placed into a grinding chamber and a grinding operation is carried out. After grinding, the grounds are transferred to a brew basket and the drip-style operation is carried out.

It is desirable to clean grinding chambers and blades of debris and oils from the coffee beans. It is desirable to clean the brew basket also. Both can be inconvenient or difficult to clean.

OBJECT OF THE PRESENT INVENTION

It is an object of the present invention to provide a grinding and brewing means for whole bean coffee that overcomes the shortcomings described above.

These and other objects are achieved by the present invention disclosed herein.

DESCRIPTION OF THE PREFERRED EMBODIMENT OF THE PRESENT INVENTION

The present invention comprises use of a pre-packaged, sealed container enclosing whole coffee beans. The quantity of beans and the size of the container may correspond to a single serving of coffee, or multiple servings. The container is designed to be used with a machine that selectively introduces a grinding blade into the container for grinding the whole beans. The blade may be lowered into the container, the container may be raised into engagement with the blade, or a combination of both may occur. The freshly made grounds remain in the same container and heated water is introduced into the container. Freshly brewed coffee is produced and drips out of one or more openings in the bottom of the container after passing through the filter. The container is sealed for storage and shipping with an airtight membrane or cover such as plastic, foil etc. The seal is removed by the user before grinding and brewing.

Grinding operations may be automatically or manually timed to ensure adequate grinding. Water portions can be dependent upon user's manual input or managed by automatic controls and valves.

After use, the container is removed and discarded, eliminating the need for cleanup associated with known grinding and brewing machines.

While the preferred embodiment of the present invention has been disclosed herein, it is understood that various modification can be made without departing from the scope of the presently claimed invention.

What is claimed is:

1. A method of grinding and brewing for whole bean coffee, comprising the steps of:

introducing a grinding blade into a capsule enclosing whole coffee beans through a fracturable top surface of said capsule;

with said grinding blade, grinding said whole coffee beans contained within said capsule to produce coffee grounds within said capsule;

while maintaining said coffee grounds within said capsule, introducing heated water into said capsule during a brewing operation to produce brewed coffee; and passing said brewed coffee through a filter within said capsule and out of at least one opening in the bottom of said capsule below said filter.

2. The method according to claim 1, furthering comprising the step of:

removing said capsule from an airtight membrane prior to the steps of grinding and brewing.

3. A method of grinding and brewing using a disposable, pre-packaged whole-bean coffee filter container, comprising the steps of:

introducing a grinding blade into a container enclosing whole coffee beans through a fracturable top surface of said container;

grinding said coffee beans within said container into coffee grounds;

holding said coffee grounds within said container during a brewing operation in which heated water is introduced into said container and over said coffee grounds;

through at least one opening in the bottom of said container below a filter, passing brewed coffee after said heated water is introduced into said container over said coffee grounds during said brewing operation;

wherein said container is configured to permit both grinding and brewing operations to be carried out within said container; and wherein a size of said container and a quantity of said whole coffee beans contained therein corresponds to a single serving of coffee.

4. The method according to claim 3, wherein:

said fracturable top surface is made of plastic.

5. The method according to claim 3, wherein:

said fracturable top surface is made of foil.

6. The method according to claim 3, further comprising the step of:

discarding the container after use.

* * * * *